US007917045B2

(12) United States Patent
Yagawara et al.

(10) Patent No.: US 7,917,045 B2
(45) Date of Patent: Mar. 29, 2011

(54) IMAGE FORMING APPARATUS AND IMAGE FORMING METHOD

(75) Inventors: Makoto Yagawara, Ibaraki (JP); Hideharu Miki, Ibaraki (JP); Souichi Nakazawa, Ibaraki (JP); Shinichi Akatsu, Ibaraki (JP); Akira Asaoka, Ibaraki (JP); Akihiko Yamazaki, Ibaraki (JP); Isao Nakajima, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 187 days.

(21) Appl. No.: 11/681,836

(22) Filed: Mar. 5, 2007

(65) Prior Publication Data

US 2007/0212086 A1 Sep. 13, 2007

(30) Foreign Application Priority Data

Mar. 6, 2006 (JP) ..... 2006-059647
Mar. 10, 2006 (JP) ..... 2006-066289
Jan. 17, 2007 (JP) ..... 2007-008207

(51) Int. Cl.
*G03G 15/00* (2006.01)

(52) U.S. Cl. ..... 399/38; 399/50; 399/49; 399/51

(58) Field of Classification Search ..... None
See application file for complete search history.

(56) References Cited

U.S. PATENT DOCUMENTS 6,377,772 B1 * 4/2002 Chowdry et al. ..... 399/302
6,404,997 B1 * 6/2002 Grace ..... 399/27
6,456,310 B1 * 9/2002 Wallace et al. ..... 347/116
6,879,787 B2 * 4/2005 Iino ..... 399/29
2003/0129006 A1 * 7/2003 Hoshi et al. ..... 399/298
2003/0202810 A1 * 10/2003 Udaka et al. ..... 399/49
2005/0008404 A1 * 1/2005 Tomizawa ..... 399/297
2005/0214007 A1 * 9/2005 Doi et al. ..... 399/55
2005/0281570 A1 * 12/2005 Takeuchi et al. ..... 399/49

FOREIGN PATENT DOCUMENTS

JP 63-300261 12/1988

* cited by examiner

*Primary Examiner* — David M Gray
*Assistant Examiner* — Roy Yi
(74) *Attorney, Agent, or Firm* — Ladas & Parry LLP

(57) ABSTRACT

An image forming apparatus forms high precision full color image by correcting the adhesion quantity of an image visualizing agent and a position shift of a visible image while performing printing process. The image forming apparatus includes an intermediate transfer unit; plural photoconductors; plural charging units; plural exposure units; plural developing units; plural first transferring units; and plural second transferring units. The intermediate transfer unit has a correction pattern image formed in a region outside a predetermined maximum document region in a direction perpendicular to the moving direction. A detector in the intermediate transfer unit detects the correction pattern image. A correction controller performs correcting, based on detection results of the detector, setting values of one or more of the charging units, the exposure units, and the developing units when a region corresponding to an interval between the visible images passes a position beneath one of the units.

17 Claims, 13 Drawing Sheets

IMAGE FORMING APPARATUS AND IMAGE FORMING METHOD

BACKGROUND OF THE INVENTION

1. Field of the Invention

The present invention relates to an image forming apparatus and an image forming method, and particularly, to an image forming apparatus and an image forming method capable of high precision image formation.

2. Description of the Related Art

In the related art, in an image forming apparatus able to form full color images on a recording medium, visible images of different colors (for example, yellow, magenta, cyan, black, and so on) are formed on plural photoconductive members (such as photoconductive drums), respectively, and these visible images are transferred to and superposed on an intermediate transferring member, or a recording medium directly to form a full color image.

In such an image forming apparatus, in order to form images with high precision, it is important for the visible images to be formed at specified image density. If the adhesion quantity of image visualizing agents, which result in the visible images, is not stable, the color tone may change, and the same image cannot be reproduced.

In addition, in order to form images with high precision, it is also important to eliminate position shift between the visible images during image transfer. If the position shift between the visible images occurs, it is difficult to obtain images with high precision.

To solve this problem, it has been proposed that in the image forming apparatus able to form full color images, registration marks be formed from the image visualizing agents of different colors on moving parts such as a paper conveyance belt, so that the image position shift is corrected based on the position information of the registration marks. For example, Japanese Laid-Open Patent Application No. 63-300261 discloses such a technique (hereinafter, referred to as "reference 1").

Usually, correction control employing the registration marks, as disclosed in reference 1, is performed when the power of the image forming apparatus is switched on, or when the image forming apparatus is initialized as the total number of printed documents reaches a preset value. In other words, the period of the correction is long.

Therefore, for an image forming apparatus having a low printing speed, it is possible to maintain image quality even when the correction period is long, but for an image forming apparatus which forms full color images on a web-like recording medium (specifically, a long continuous belt-like recording medium, such as, continuous paper), for example, which is conveyed at a speed over a few tens inches per second, since the position shift is associated with the tolerance of component parts (here, the tolerance is defined to be the difference between allowed maximum and the minimum errors of a workpiece to be machined), the position shift is apt to be accumulated compared to the low-speed image forming apparatus.

In addition, although an image forming apparatus able to form full color images on continuous paper is disclosed in reference 1, since the registration marks are formed at the two edges of the continuous paper, it is necessary to cut the two edges of the continuous paper to remove the registration marks after the images are formed; thereby, the efficiency is poor.

SUMMARY OF THE INVENTION

The present invention may solve one or more problems of the related art.

A preferred embodiment of the present invention may provide an image forming apparatus able to form a full color image with high precision by correcting the adhesion quantity of an image visualizing agent and position shift of a visible image during a printing process.

According to a first aspect of the present invention, there is provided an image forming apparatus, comprising:

an intermediate transfer unit;

a plurality of photoconductors that are arranged along a moving direction of the intermediate transfer unit;

a plurality of charging units that uniformly charge surfaces of the photoconductors;

a plurality of exposure units that form electrostatic latent images exposed on the surfaces of the charged photoconductors;

a plurality of developing units that supply image visualizing agents on the photoconductors retaining the electrostatic latent images, and form visible images on the photoconductors;

a plurality of first transferring units that transfer the visible images formed on the photoconductors to the intermediate transfer unit; and a plurality of second transferring units that transfer the visible images on the intermediate transfer unit to a recording medium, wherein the intermediate transfer unit has a correction pattern image formed in a region out of a predetermined maximum document region of the intermediate transfer unit in a direction perpendicular to the moving direction, a detector is provided in the intermediate transfer unit at a position opposite to the correction pattern image for detecting the correction pattern image, a correction controller is provided for correcting, based on detection results of the detector, setting values of one or more of the charging units, the exposure units, and the developing units when a region corresponding to an interval between the visible images formed on the photoconductors passes a position beneath the one of the charging units, the exposure units, and the developing units.

According to the present invention, it is possible to make corrections with high precision during a printing process, thus, it is possible to form images with high precision.

As an embodiment, the detector detects the adhesion quantity of the image visualizing agent from the correction pattern image formed on the intermediate transfer unit by the first transferring units.

According to an embodiment of the present invention, it is possible to correct the adhesion quantity of the image visualizing agent with high precision during the printing process.

As an embodiment, the correction controller corrects a charging voltage of the charging units or a developing bias voltage of the developing units based on the adhesion quantity of the image visualizing agent detected by the detector.

According to an embodiment of the present invention, it is possible to optimize the adhesion quantity of the image visualizing agent by correcting the charging voltage of the charging units or the developing bias voltage of the developing units; thereby, it is possible to form images with high precision.

As an embodiment, the correction controller corrects an exposure flux of the exposure units based on the adhesion quantity of the image visualizing agent detected by the detector.

According to an embodiment of the present invention, it is possible to optimize the adhesion quantity of the image visualizing agent by correcting the exposure flux of the exposure units; thus, it is possible to form images with high precision.

As an embodiment, the detector detects position shift of the visible images from the correction pattern image formed on the intermediate transfer unit by the first transferring units.

According to an embodiment of the present invention, based on the position shift, it is possible to make corrections with high precision during a printing process.

As an embodiment, based on the position shift detected by the detector, the correction controller corrects one or more of a write starting position in a main scan direction of a laser beam emitted from the exposure units on the photoconductors, scan magnification of the laser beam, and a write starting position in a sub scan direction of the laser beam on the photoconductors.

According to an embodiment of the present invention, it is possible to correct the printing starting position or the width at predetermined timing even during a continuous printing process without stopping the printing process. Thus, it is possible to make corrections with high precision during a printing process.

As an embodiment, the recording medium is a web-like recording medium.

According to an embodiment of the present invention, even when the recording medium is a web-like recording medium, it is possible to make corrections with high precision during a printing process.

According to a second aspect of the present invention, there is provided an image forming method of an image forming apparatus including an intermediate transfer unit; a plurality of photoconductors that are arranged along a moving direction of the intermediate transfer unit; a plurality of charging units that uniformly charge surfaces of the photoconductors; a plurality of exposure units that form electrostatic latent images exposed on the surfaces of the charged photoconductors; a plurality of developing units that supply image visualizing agents on the photoconductors retaining the electrostatic latent images, and form visible images on the photoconductors; a plurality of first transferring units that transfer the visible images formed on the photoconductors to the intermediate transfer unit; and a plurality of second transferring units that transfer the visible images on the intermediate transfer unit to a recording medium, said method comprising:

a detection step of detecting a correction pattern image formed in a region out of a predetermined maximum document region of the intermediate transfer unit in a direction perpendicular to the moving direction; and a correction control step of correcting, based on detection results obtained in the detection step, setting values of one or more of the charging units, the exposure units, and the developing units when a region corresponding to an interval between the visible images passes a position beneath the one of the charging units, the exposure units, and the developing units.

According to an embodiment of the present invention, it is possible to make corrections with high precision during a printing process, thus, it is possible to form images with high precision.

As an embodiment, in the detection step, adhesion quantity of the image visualizing agent is detected from the correction pattern image formed on the intermediate transfer unit by the first transferring units.

According to an embodiment of the present invention, it is possible to correct the adhesion quantity of the image visualizing agent with high precision during the printing process.

As an embodiment, in the correction control step, a charging voltage of the charging units or a developing bias voltage of the developing units is corrected based on the adhesion quantity of the image visualizing agent detected by the detector.

According to an embodiment of the present invention, it is possible to optimize the adhesion quantity of the image visualizing agent by correcting the charging voltage of the charging units or the developing bias voltage of the developing units; thereby, it is possible to form images with high precision.

As an embodiment, in the correction control step, an exposure flux of the exposure units is corrected based on the adhesion quantity of the image visualizing agent detected by the detector.

According to an embodiment of the present invention, it is possible to optimize the adhesion quantity of the image visualizing agent by correcting the exposure flux of the exposure units, thus, it is possible to form images with high precision.

As an embodiment, in the detection step, position shift of the visible images is detected from the correction pattern image formed on the intermediate transfer unit by the first transferring units.

According to an embodiment of the present invention, based on the position shift, it is possible to make corrections with high precision during a printing process.

As an embodiment, in the correction control step, based on the position shift detected in the detection step, one or more of a write starting position in a main scan direction of a laser beam emitted from the exposure units on the photoconductors, scan magnification of the laser beam, and a write starting position in a sub scan direction of the laser beam on the photoconductors is corrected.

According to an embodiment of the present invention, it is possible to correct the printing starting position or the width at predetermined timing even during a continuous printing process without stopping the printing process. Thus, it is possible to make corrections with high precision during a printing process.

These and other objects, features, and advantages of the present invention will become more apparent from the following detailed description of preferred embodiments given with reference to the accompanying drawings.

DESCRIPTION OF THE PREFERRED EMBODIMENTS

Below, preferred embodiments of the present invention are explained with reference to the accompanying drawings.

First Embodiment

In this embodiment, descriptions are made of a method of correcting adhesion quantity of image visualizing agents in an image forming apparatus of the present invention.

<Configuration of Image Forming Apparatus>

Figure 1:
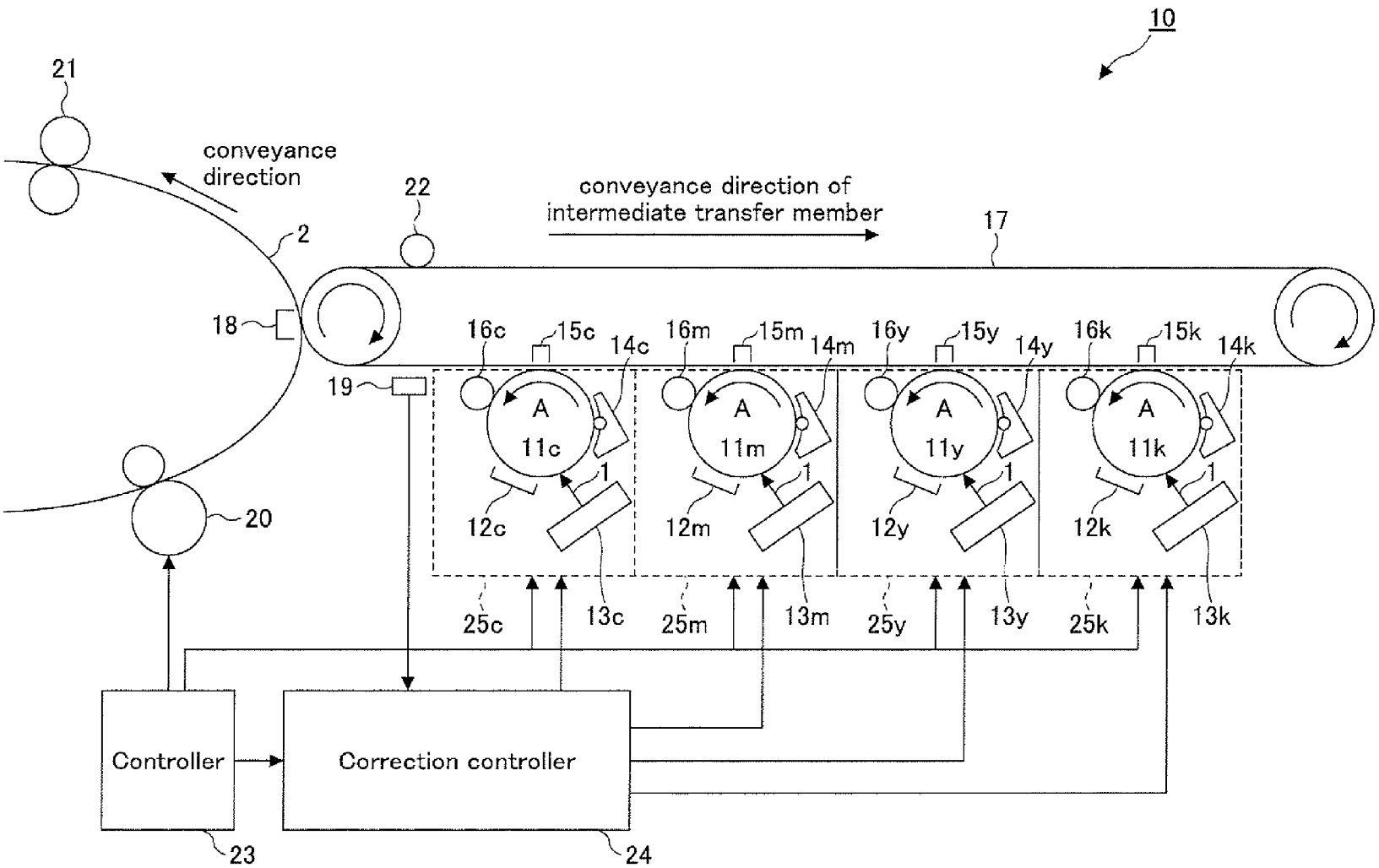
FIG. 1 is a block diagram schematically illustrating a configuration of an image forming apparatus according to a first embodiment of the present invention.

FIG. 1 is a block diagram schematically illustrating a configuration of an image forming apparatus according to a first embodiment of the present invention.

Specifically, FIG. 1 shows an example of a schematic overall configuration of a tandem image forming apparatus 10 able to form color images.

The image forming apparatus 10 shown in FIG. 1 includes photoconductive members (for example, photoconductive drums) 11*k*, 11*y*, 11*m*, 11*c*, charging units 12*k*, 12*y*, 12*m*, 12*c*, exposure units 13*k*, 13*y*, 13*m*, 13*c* which emit laser beams 1 to specified positions at specified exposure flux, developing units 14*k*, 14*y*, 14*m*, 14*c*, first transferring units 15*k*, 15*y*, 15*m*, 15*c*, first cleaners 16*k*, 16*y*, 16*m*, 16*c*, an intermediate transfer unit (for example, an intermediate transfer belt) 17 which performs a first transfer from the photoconductive members 11*k*, 11*y*, 11*m*, 11*c*, a second transferring unit 18, a detector 19, a fusing unit 21, a second cleaner 22, a controller 23, and a correction controller 24. In the image forming apparatus 10, the photoconductive members 11*k*, 11*y*, 11*m*, 11*c*, the charging units 12*k*, 12*y*, 12*m*, 12*c*, the exposure units 13*k*, 13*y*, 13*m*, 13*c*, the developing units 14*k*, 14*y*, 14*m*, 14*c*, the first transferring units 15*k*, 15*y*, 15*m*, 15*c*, and the first cleaners 16*k*, 16*y*, 16*m*, 16*c* constitute image forming sections 25*k*, 25*y*, 25*m*, 25*c* for forming visible toner images of color components black (K), yellow (Y), magenta (N), cyan (C), respectively.

Below, where necessary, the photoconductive members 11*k*, 11*y*, 11*m*, 11*c*, the charging units 12*k*, 12*y*, 12*m*, 12*c*, the exposure units 13*k*, 13*y*, 13*m*, 13*c*, the developing units 14*k*, 14*y*, 14*m*, 14*c*, the first transferring units 15*k*, 15*y*, 15*m*, 15*c*, the first cleaners 16*k*, 16*y*, 16*m*, 16*c*, and the image forming section 25*k*, 25*y*, 25*m*, 25*c* are represented as the photoconductive members 11, the charging units 12, the exposure units 13, the developing units 14, the first transferring units 15, the first cleaners 16, and the image forming section 25, respectively.

The photoconductive members 11 for different colors are rotated at a specified timing and speed.

The charging units 12 uniformly charge the surfaces of the photoconductive members 11.

The exposure units 13 emit laser beams to the surfaces of the charged photoconductive members 11 to form electrostatic latent images on the charged photoconductive members 11.

The developing units 14 supply image visualizing agents for visualizing images of different colors, such as toner for forming images of different colors, on the electrostatic latent images on the photoconductive members 11.

The first transferring units 15 transfer the images of different colors on the photoconductive members 11 to predetermined positions of the intermediate transfer unit 17, which is rotated at a specified timing and speed. This process is referred to as "the first transfer". As a result, a visible color image is formed on the intermediate transfer unit 17.

The image forming section 25 forms the visible image to be printed on the intermediate transfer unit 17, and forms a correction pattern image (described below) at a specified position on the intermediate transfer unit 17.

The first cleaners 16 remove the residual toner adhering to the photoconductive members 11 after the first transfer.

The second transferring unit 18 transfers the visible image on the intermediate transfer unit 17 to a recording medium 2, such as a sheet of paper which is rotated at a specified timing and at a specified speed by a conveyance unit 20. This process is referred to as "the second transfer". As a result, a visible color image is formed on the recording medium 2.

One or more detectors 19 are provided in the image forming apparatus 10 at a position close to the conveyance path of the intermediate transfer unit 17. The detector 19 includes a sensor for optically reading the correction pattern image (described below) formed on the intermediate transfer unit 17. The detector 19 has a function of detecting the preferable quantity of the image visualizing agents adhering to the photoconductive members 11 from the obtained color information and color fluctuation of the correction pattern image. This quantity of the image visualizing agents adhering to the photoconductive members 11 is abbreviated as "adhesion quantity of the image visualizing agent" where necessary. Namely, the detector 19 has a functional section of detecting the adhesion quantity of the image visualizing agent. The detector 19 outputs the detection results to the correction controller 24. The method of detecting the adhesion quantity of the image visualizing agent by the detector 19 is described below.

The fusing unit 21 allows the recording medium 2 to pass through so as to fuse the visible image (toner image), which is transferred from the intermediate transfer unit 17 to the recording medium 2. For example, the fusing unit 21 includes two rollers, and is able to supply heat to the recording medium 2 passing through between the two rollers, thereby fusing the visible image.

The second cleaner 22 removes the residual toner adhering to the intermediate transfer unit 17 after the second transfer.

The controller 23 controls overall operations of the constituent components of the image forming apparatus 10. Specifically, the controller 23 directs the correction controller 24 to perform control for correcting the adhesion quantity of the image visualizing agent at specified timings, directs the conveyance unit 20 to convey recording media 2 at a specified timing and a specified speed, controls the operations of driving the photoconductive members 11 to rotate, controls the charging units 12 to charge the surfaces of the photoconductive members 11, controls the exposure units 13 to emit laser beams onto the photoconductive members 11, and controls the developing units 14 to supply the image visualizing agents on the photoconductive members 11.

The controller 23 inputs to the correction controller 24 information of page intervals between successive recording media 2, which are conveyed at a specified speed by the conveyance unit 20; and information of speeds of the photoconductive members 11, the intermediate transfer unit 17, and the recording medium 2. In addition, the controller 23 controls a paper feeding signal of the recording medium 2, a system clock signal, or others, and outputs these signals to the correction controller 24. Hence, in the correction controller 24, timing information such as the page intervals is obtainable.

The correction controller 24 compares the detection results of the detector 19 to a correction criterion, for example, a preset reference value of the adhesion quantity of the image visualizing agent, determines whether it is necessary to correct the adhesion quantity of the image visualizing agent, and generates a control signal for correcting the adhesion quantity of the image visualizing agent if it is determined that it is necessary to make the correction. In addition, based on the timing information such as the page intervals from the controller 23, the correction controller 24 supplies the correction control signal to one or more of the charging units 12, the exposure units 13, and the developing units 14, and adjusts the setting values of the units to which the correction control signal is supplied at preset timings to adjust the adhesion quantity of the image visualizing agent. Specifically, the correction controller 24 corrects the charging voltage of the charging units 12, corrects the developing bias voltage of the developing units 14, or corrects the exposure flux of the exposure units 13 to adjust the adhesion quantity of the image visualizing agent. According to the present invention, it is possible to correct the adhesion quantity of the image visualizing agent with high precision during a printing process.

<Image Forming Process>

Next, descriptions are made of an image forming process in the image forming apparatus 10 of the present invention.

First, at a dark place, the charging units 12*k*, 12*y*, 12*m*, and 12*c* uniformly charge the surfaces of the photoconductive members 11*k*, 11*y*, 11*m*, and 11*c*.

Next, according to data of an image to be printed, the exposure units 13*k*, 13*y*, 13*m*, 13*c* emit laser beams, and remove charges at portions on the photoconductive members 11*k*, 11*y*, 11*m*, 11*c* irradiated by the laser beams; thereby, electrostatic latent images are formed on the photoconductive members 11*k*, 11*y*, 11*m*, 11*c*.

The developing units 14*k*, 14*y*, 14*m*, and 14*c* supply toner, which includes charged colored fine particles, on the electrostatic latent images on the photoconductive members 11*k*, 11*y*, 11*m*, and 11*c* to convert the latent images to visible images.

The first transferring units 15*k*, 15*y*, 15*m*, 15*c* transfer the developed toner images on the photoconductive members 11*k*, 11*y*, 11*m*, 11*c* to the intermediate transfer unit 17, and the toner images are superposed on the intermediate transfer unit 17. As a result, a color image is formed on the intermediate transfer unit 17.

The second transferring unit 18 transfers (namely, the second transfer) the color image on the intermediate transfer unit 17 to the web-like recording medium 2, such as a long continuous belt-like recording medium. As a result, a visible color image is formed on the recording medium 2. The recording medium 2 passes through the fusing unit 21, and is conveyed to an area for accommodating the recording medium 2.

Next, descriptions are made of a method of detecting the adhesion quantity of the image visualizing agent used for correcting the adhesion quantity, and of the timing of correcting the adhesion quantity.

<First Example of Detection of Adhesion Quantity>

Figure 2:
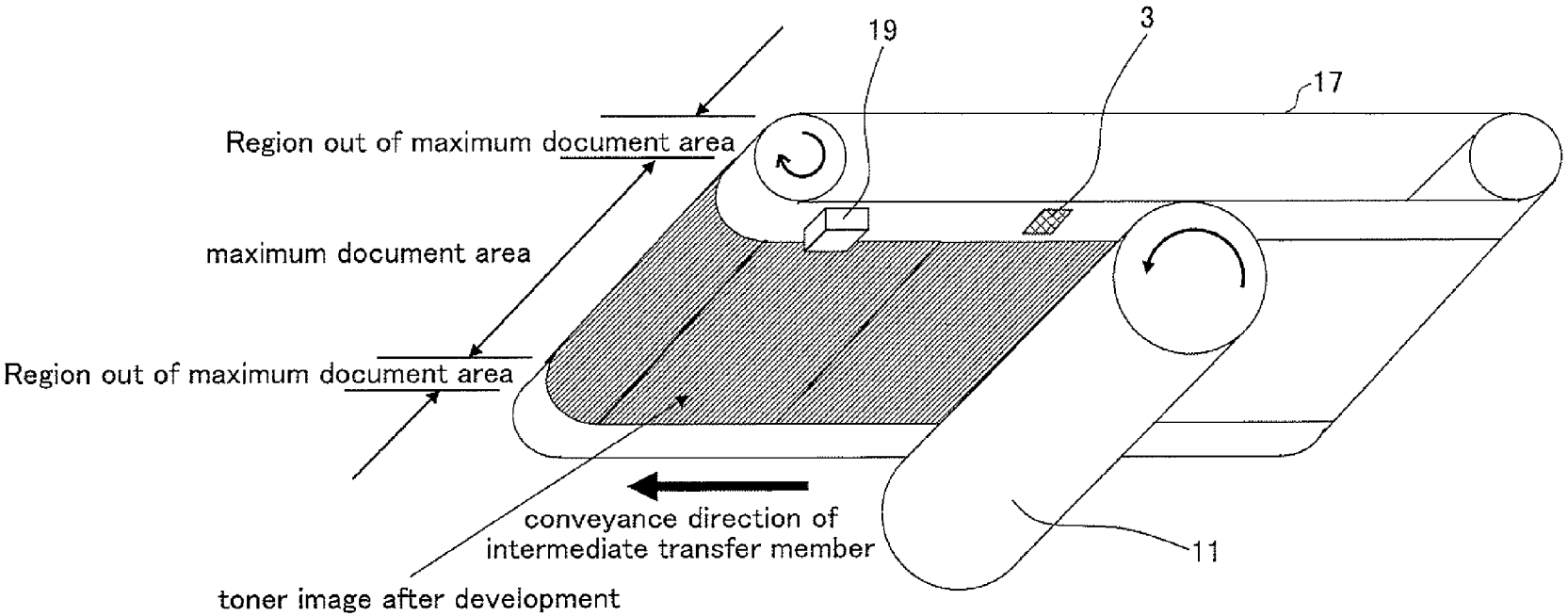
FIG. 2 is a schematic view of a principal portion of the image forming apparatus 10 according to the present embodiment for illustrating the first example of a method of detecting the adhesion quantity of the image visualizing agent.

FIG. 2 is a schematic view of a principal portion of the image forming apparatus 10 according to the present embodiment for illustrating the first example of a method of detecting the adhesion quantity of the image visualizing agent.

As shown in FIG. 2, during a process of continuously printing on a web-like recording medium, a correction pattern image 3 for use in correcting the adhesion quantity of the image visualizing agents of different colors (below, abbreviated as "correction pattern image"), which are formed (transferred) by the image forming sections 25*k*, 25*y*, 25*m*, 25*c*, is formed on the intermediate transfer unit 17 in a region outside the maximum document region of the intermediate transfer unit (the region corresponding to the available maximum size of the recording medium) in the transverse direction of the intermediate transfer unit 17 (the direction perpendicular to the moving direction, namely, the conveyance direction of the intermediate transfer unit 17). For example, the correction pattern image 3 is formed on one side outside the maximum document region of the intermediate transfer unit 17 in the transverse direction of the intermediate transfer unit 17. Further, for example, the correction pattern image 3 may have one or more colors among black (K), yellow (Y), magenta (M), and cyan (C). In addition, the correction pattern image 3 may have a specified pattern.

In the present example, one detector 19 is provided at such a position that the detector 19 is able to optically read the correction pattern image 3 at a position as shown in FIG. 2. The correction pattern image 3 moves along with the rotating intermediate transfer unit 17, and the detector 19 optically reads the correction pattern image 3 when the correction pattern image 3 passes in front of the detector 19. Further, the detector 19 detects the adhesion quantity of the image visualizing agent from the obtained correction pattern image 3.

The correction controller 24 compares the detection results of the detector 19 to a preset correction criterion to determine whether it is necessary to correct the adhesion quantity of the image visualizing agent. When it is determined that it is necessary to make the correction, the correction controller 24 generates a control signal for correcting the adhesion quantity of the image visualizing agent.

In addition, the correction controller 24 supplies the correction control signal to one or more of the charging units 12, the exposure units 13, and the developing units 14, and adjusts the setting values of the units to which the correction control signal is supplied at preset timings to adjust the adhesion quantity of the image visualizing agent. Specifically, the correction controller 24 corrects the charging voltage of the charging units 12, corrects the developing bias voltage of the developing units 14, or corrects the exposure flux of the exposure units 13 to adjust the adhesion quantity of the image visualizing agent.

According to the present example, it is possible to correct the adhesion quantity of the image visualizing agent without stopping the printing process.

The timing of correcting the adhesion quantity is described below.

<Second Example of Detection of Adhesion Quantity>

Figure 3:
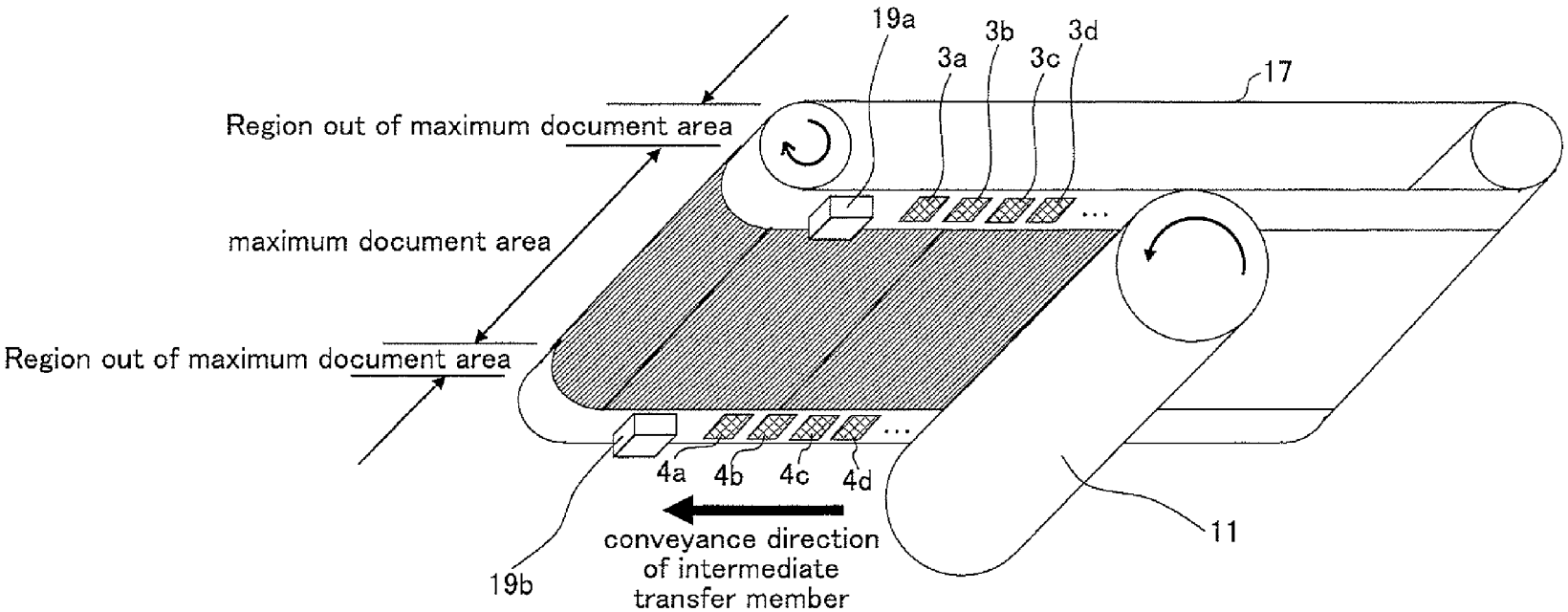
FIG. 3 is a schematic view of a principal portion of the image forming apparatus 10 according to the present embodiment for illustrating the second example of the method of detecting the adhesion quantity of the image visualizing agent.

FIG. 3 is a schematic view of a principal portion of the image forming apparatus 10 according to the present embodiment for illustrating the second example of the method of detecting the adhesion quantity of the image visualizing agent.

As shown in FIG. 3, plural correction pattern images 3*a*, 3*b*, 3*c*, 3*d*, and 4*a*, 4*b*, 4*c*, 4*d* are arranged on the respective two sides of the intermediate transfer unit 17 outside the maximum document region of the intermediate transfer unit 17 in the transverse direction of the intermediate transfer unit 17 (the direction perpendicular to the moving direction or the conveyance direction of the intermediate transfer unit 17). For example, the correction pattern images 3*a*, 3*b*, 3*c*, 3*d*, and 4*a*, 4*b*, 4*c*, 4*d* are respectively arranged in lines along the conveyance direction of the intermediate transfer unit 17.

For example, the correction pattern images 3*a*, 3*b*, 3*c*, 3*d* are the same as the correction pattern images 4*a*, 4*b*, 4*c*, 4*d*, respectively, and each of the correction pattern images 3*a*, 3*b*, 3*c*, 3*d*, and 4*a*, 4*b*, 4*c*, 4*d* may have one or more colors among black (K), yellow (Y), magenta (M), and cyan (C), and may have a specified pattern.

In the present example, two detectors 19*a*, 19*b* are provided on the respective two sides of the intermediate transfer unit 17 at positions corresponding to the correction pattern images 3*a*, 3*b*, 3*c*, 3*d*, and 4*a*, 4*b*, 4*c*, 4*d*, respectively. The detectors 19*a*, 19*b* optically read the correction pattern images 3*a*, 3*b*, 3*c*, 3*d*, and 4*a*, 4*b*, 4*c*, 4*d*, respectively, and detect the adhesion quantity of the image visualizing agent from the obtained correction pattern images 3*a*, 3*b*, 3*c*, 3*d*, and 4*a*, 4*b*, 4*c*, 4*d*.

The correction controller 24 averages the detection results of the detectors 19*a* and 19*b* on the two sides of the intermediate transfer unit 17, and compares the averaged detection results to a preset correction criterion to determine whether it is necessary to correct the adhesion quantity of the image visualizing agent. When it is determined that it is necessary to make the correction, the correction controller 24 generates a control signal for correcting the adhesion quantity of the image visualizing agent.

In addition, the correction controller 24 supplies the correction control signal to one or more of the charging units 12, the exposure units 13, and the developing units 14, and adjusts the setting values of the units to which the correction control signal is supplied at preset timings to adjust the adhesion quantity of the image visualizing agent. Specifically, the correction controller 24 corrects one or more of the charging voltage of the charging units 12, the developing bias voltage of the developing units 14, and the exposure flux of the exposure units 13 to adjust the adhesion quantity of the image visualizing agent.

According to the present example, with plural correction pattern images 3 and 4 arranged on the two sides of the intermediate transfer unit 17, it is possible to correct the adhesion quantity of the image visualizing agent with high precision.

It should be noted that the correction pattern images 3 and 4 on the two sides of the intermediate transfer unit 17 may be different. For example, yellow and cyan correction pattern images 3 may be formed on one side, and magenta and black correction pattern images 4 may be formed on the other side, and the detectors 19*a* and 19*b* can detect these correction pattern images 3 and 4 separately. In this way, it is possible to detect the adhesion quantity, quickly.

<Third Example of Detection of Adhesion Quantity>

Figure 4A:
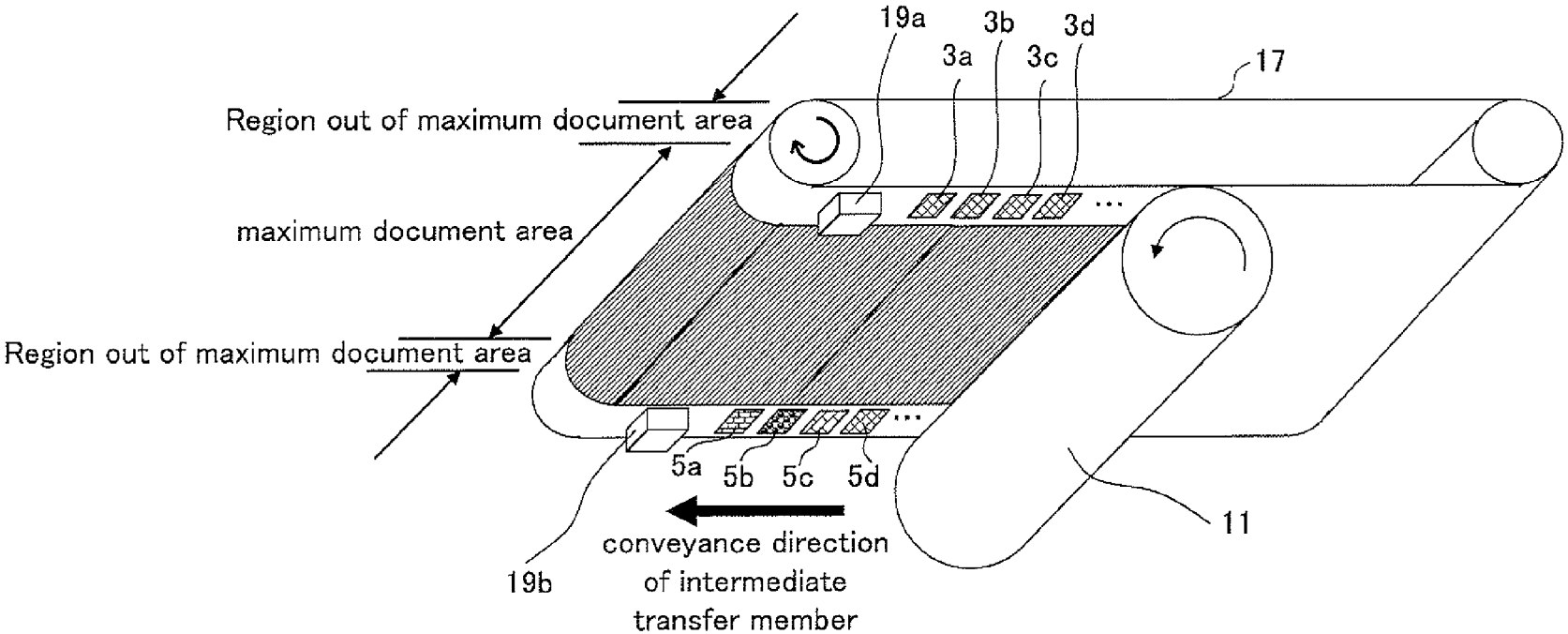
FIG. 4A is a schematic view of a principal portion of the image forming apparatus 10 according to the present embodiment for illustrating the third example of the method of detecting the adhesion quantity of the image visualizing agent.

FIG. 4A is a schematic view of a principal portion of the image forming apparatus 10 according to the present embodiment for illustrating the third example of the method of detecting the adhesion quantity of the image visualizing agent.

As shown in FIG. 4A, plural correction pattern images 3*a*, 3*b*, 3*c*, 3*d*, and 5*a*, 5*b*, 5*c*, 5*d* are arranged on the respective two sides of the intermediate transfer unit 17 outside the maximum document region of the intermediate transfer unit 17 in the transverse direction of the intermediate transfer unit 17 (the direction perpendicular to the moving direction or the conveyance direction of the intermediate transfer unit 17). For example, the correction pattern images 3*a*, 3*b*, 3*c*, 3*d*, and 5*a*, 5*b*, 5*c*, 5*d* are different images. Specifically, the correction pattern images 3*a*, 3*b*, 3*c*, 3*d*, which are on one side of the recording medium, may have one or more colors among black (K), yellow (Y), magenta (M), and cyan (C), and may have a specified pattern, whereas, the correction pattern images 5*a*, 5*b*, 5*c*, 5*d*, which are on the other side of the recording medium, may be images having plural grade levels for detecting plural image densities.

In the present example, two detectors 19*a*, 19*b* are provided on the respective two sides of the intermediate transfer unit 17 at positions corresponding to the correction pattern images 3*a*, 3*b*, 3*c*, 3*d*, and the correction pattern images 5*a*, 5*b*, 5*c*, 5*d*, respectively. The detectors 19*a*, 19*b* optically read the correction pattern images 3*a*, 3*b*, 3*c*, 3*d*, and the correction pattern images 5*a*, 5*b*, 5*c*, 5*d*, respectively, obtain various kinds of information from the obtained correction pattern images 3*a*, 3*b*, 3*c*, 3*d*, and 5*a*, 5*b*, 5*c*, 5*d*, and appropriately perform corrections based on the detection results.

Figure 4B:
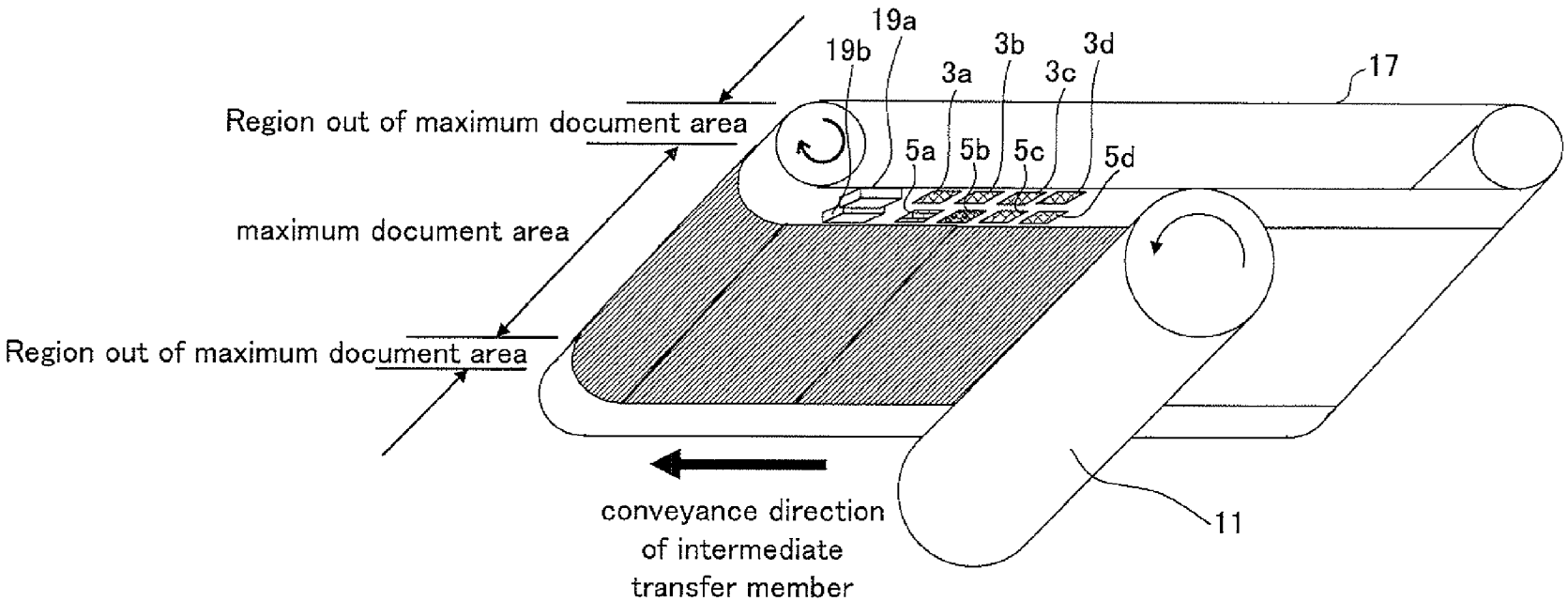
FIG. 4B is a schematic view of a principal portion of the image forming apparatus 10 according to the present embodiment for illustrating a modification to the third example of the method of detecting the adhesion quantity of the image visualizing agent.

FIG. 4B is a schematic view of a principal portion of the image forming apparatus 10 according to the present embodiment for illustrating a modification to the third example of the method of detecting the adhesion quantity of the image visualizing agent.

As shown in FIG. 4B, instead of the arrangement in FIG. 4A, correction pattern images 3*a*, 3*b*, 3*c*, 3*d* and 5*a*, 5*b*, 5*c*, 5*d* may be arranged respectively in lines and on the same side of the intermediate transfer unit 17 outside the maximum document region of the intermediate transfer unit 17 in the transverse direction of the intermediate transfer unit 17 (the direction perpendicular to the moving direction or the conveyance direction of the intermediate transfer unit 17). Further, the two detectors 19*a*, 19*b* are provided on the same side of the intermediate transfer unit 17 at positions corresponding to the correction pattern images 3*a*, 3*b*, 3*c*, 3*d*, and the correction pattern images 5*a*, 5*b*, 5*c*, 5*d*, respectively. The detectors 19*a*, 19*b* optically read the correction pattern images 3*a*, 3*b*, 3*c*, 3*d*, and the correction pattern images 5*a*, 5*b*, 5*c*, 5*d*, respectively, obtain various kinds of information, and appropriately perform corrections based on the detection results.

<First Example of Adhesion Quantity Correction Timing>

Next, descriptions are made of the timing of correcting the adhesion quantity with reference to the drawings.

Figure 5:
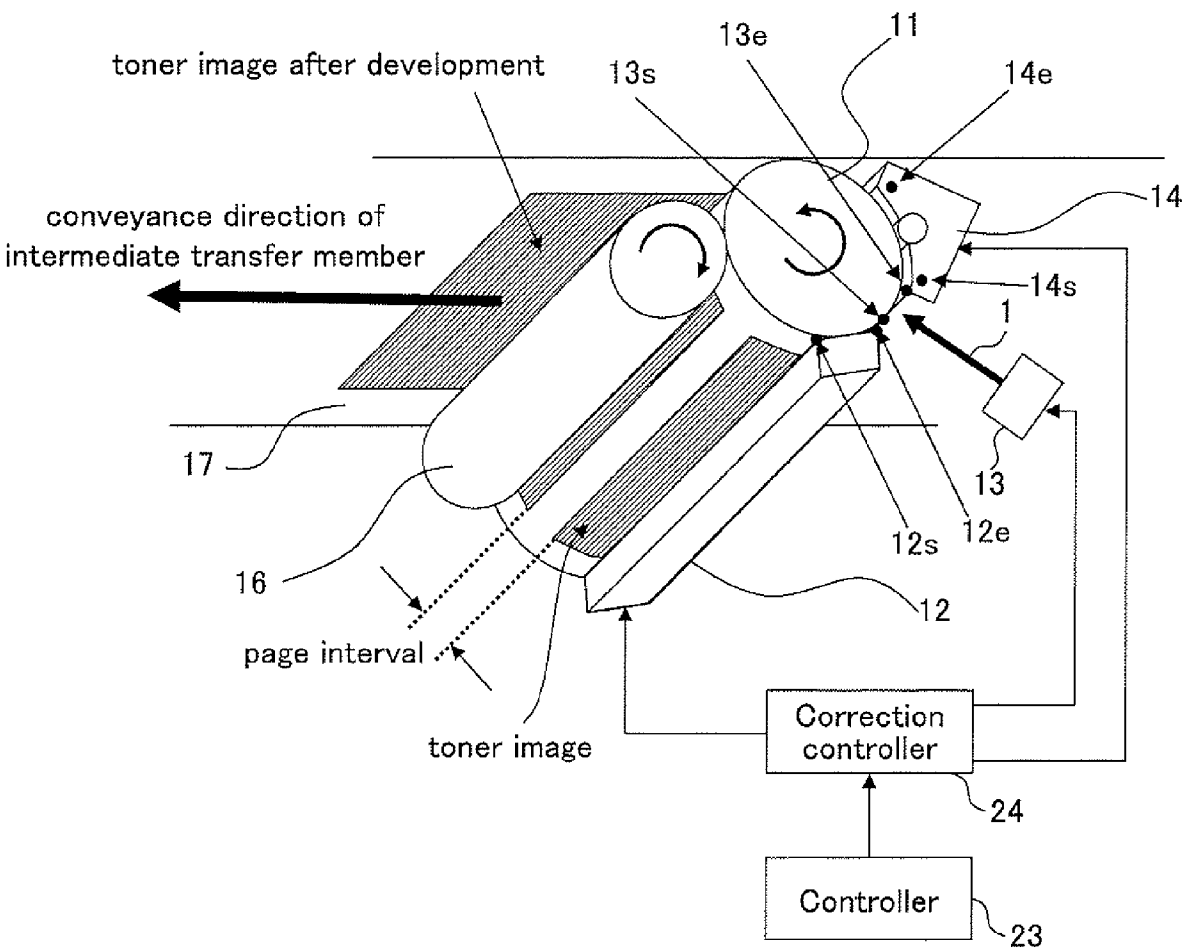
FIG. 5 is a schematic view of the image forming section 25 of the image forming apparatus according to the present embodiment for illustrating a first example of the correction timing.

FIG. 5 is a schematic view of the image forming section 25 of the image forming apparatus according to the present embodiment for illustrating a first example of the correction timing.

As illustrated in FIG. 5, the image forming apparatus of the present embodiment includes the controller 23 and the correction controller 24.

In order to control the correction values, the correction controller 24 obtains the detection results of the detector 19, generates a control signal for correcting the adhesion quantity of the image visualizing agent based on the detection results of the detector 19, and based on the timing information such as the page intervals obtained from the controller 23, the correction controller 24 supplies the correction control signal to one or more of the charging units 12, the exposure units 13, and the developing units 14, and adjusts the setting values of the units to which the correction control signal is supplied at preset timings. Specifically, the correction controller 24 corrects one or more of the charging voltage of the charging units 12, the developing bias voltage of the developing units 14, and the exposure flux of the exposure units 13.

Specifically, as shown in FIG. 5, when the position corresponding to the page interval between successive visible images (toner images) on the photoconductive member 11 is under the charging unit 12, namely, between a position 12*s* where charging is started and a position 12*e* where charging is finished as shown in FIG. 5, the correction controller 24 adjusts the charging voltage of the charging unit 12. In other words, the correction controller 24 adjusts the charging voltage of the charging unit 12 at the timing when the position corresponding to the page interval arrives at a position beneath the charging unit 12.

In addition, when the position corresponding to the page interval between successive visible images (toner images) on the photoconductive member 11 is under the developing unit 14, namely, between a position 14*s* where developing is started and a position 14*e* where developing is finished as shown in FIG. 5, the correction controller 24 adjusts the developing bias voltage of the developing unit 14. In other words, the correction controller 24 adjusts the developing bias voltage of the developing unit 14 at the timing when the position corresponding to the page interval arrives at a position beneath the developing unit 14.

In order to determine the end of one page, for example, a stepping motor or a rotary encoder can be mounted on the photoconductive member 11, and the position of the recording medium 2 can be determined accurately from the step number of the stepping motor or the rotation number of the rotary encoder.

Figure 6:
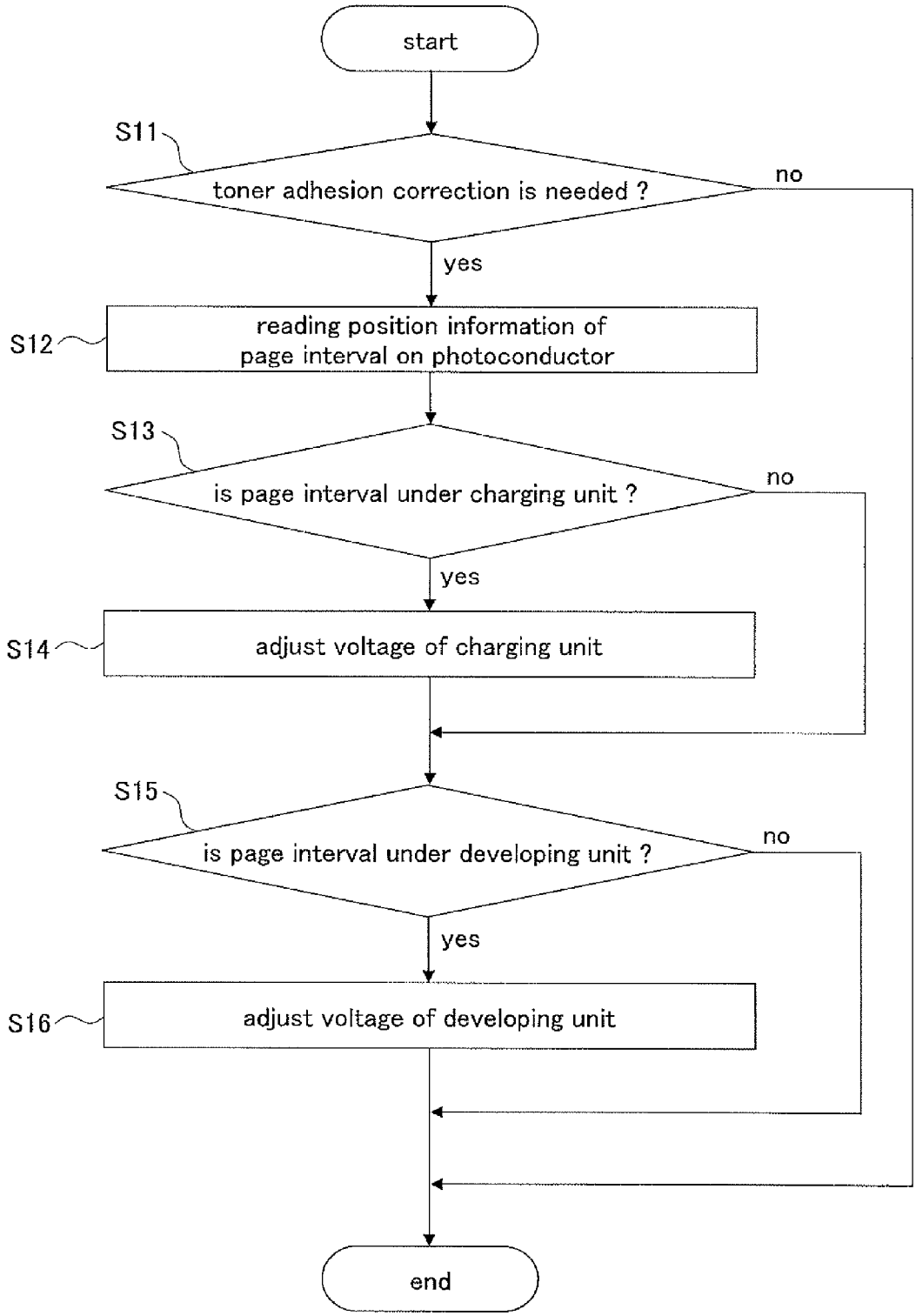
FIG. 6 is a flowchart illustrating a method of correcting the toner adhesion quantity according to the first example of adhesion quantity detection method.

FIG. 6 is a flowchart illustrating a method of correcting the toner adhesion quantity according to the first example of the adhesion quantity detection method.

As shown in FIG. 6, in step S11, based on the detection results of the detector 19, it is determined whether it is necessary to perform toner adhesion correction during the printing process.

If it is necessary to perform the toner adhesion correction, the routine proceeds to step 12R, otherwise, the routine is ended.

When making the above determination, for example, when the difference between the detection results of the detector 19 and a preset correction criterion, such as the toner adhesion quantity, is greater than a preset value, the correction controller 24 determines that the process of toner adhesion quantity correction is necessary.

In step S12, the position information of the page interval between the toner images on the photoconductive member 11 is read in.

In step S13, it is determined whether the page interval between the toner images is under the charging unit 12.

If the page interval is under the charging unit 12, the routine proceeds to step S14, otherwise, the routine proceeds to step S15.

In step S14, the charging voltage of the charging unit 12 is adjusted.

In step S15, after step S14 or if the page interval is not under the charging unit 12, it is determined whether the page interval between the toner images is under the developing unit 14.

If the page interval is under the developing unit 14, the routine proceeds to step S16, otherwise, the routine is ended.

In step S16, the developing bias voltage of the developing unit 14 is adjusted.

When it is not necessary to perform the toner adhesion quantity correction procedure, or the page interval is not under the developing unit 14, the routine is ended.

The above toner adhesion quantity correction procedure is executed for each color of black (K), yellow (Y), magenta (M), cyan (C). In addition, a maximum correction value may be set in advance, and when a calculated correction value is greater than the maximum correction value, the actual correction value 5 can be decreased so as to make the correction step by step. Due to this, it is possible to prevent the photoconductive member 11, or any other components from being damaged and degraded by a sudden change of the charging voltage or the developing bias voltage.

Therefore, it is possible to correct the adhesion quantity of the image visualizing agent with high precision during a process of continuous printing.

<Second Example of Adhesion Quantity Correction Timing>

Next, the second example of the timing of correcting the adhesion quantity is described. In this example, the exposure flux of the exposure units 13 is adjusted based on the detection results of the toner adhesion quantity from the detector 19.

Specifically, as shown in FIG. 5, when the position corresponding to the page interval between successive visible images (toner images) on the photoconductive member 11 is under the exposure units 13, namely, between a position 13*s* where laser exposure is started and a position 13*e* where the laser exposure is finished as shown in FIG. 5, the correction controller 24 adjusts the exposure flux of the exposure units 13. In other words, the correction controller 24 adjusts the exposure flux of the exposure units 13 at the timing when the position corresponding to the page interval arrives at a position beneath the exposure units 13.

Figure 7:
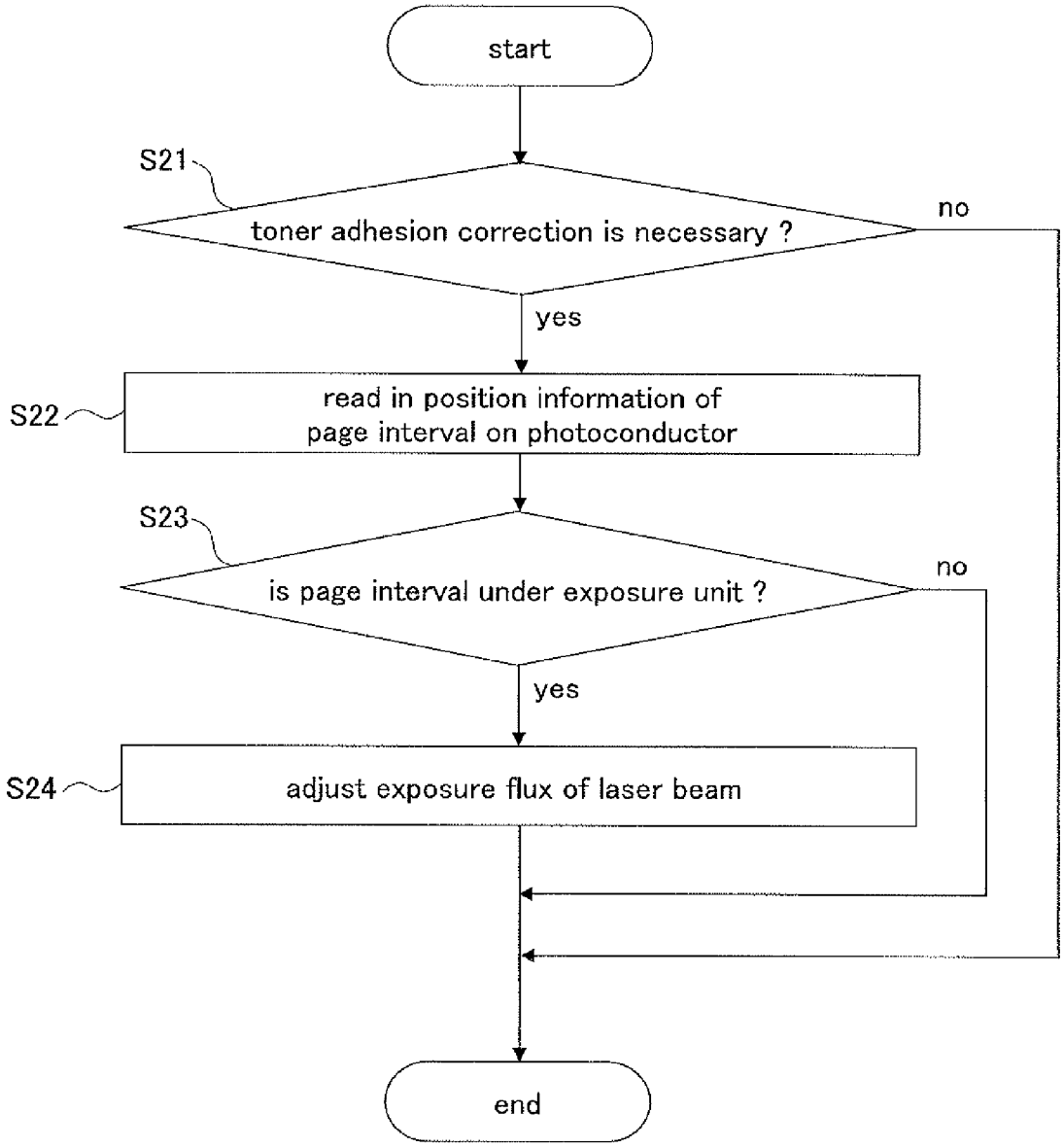
FIG. 7 is a flowchart illustrating a method of correcting the toner adhesion quantity according to the second example of adhesion quantity detection method.

FIG. 7 is a flowchart illustrating a method of correcting the toner adhesion quantity according to the second example of adhesion quantity detection method.

As shown in FIG. 7, in step S21, based on the detection results of the detector 19, it is determined whether it is necessary to perform toner adhesion quantity correction during the printing process.

If it is necessary to perform the toner adhesion quantity correction, the routine proceeds to step S22, otherwise, the routine is ended.

When making the above determination, for example, when the difference between the detection results of the detector 19 and a preset correction criterion, such as the toner adhesion quantity, is greater than a preset value, the correction controller 24 determines that the process of toner adhesion quantity correction is necessary.

In step S22, the position information of the page interval between toner images on the photoconductive member 11 is read in.

In step S23, it is determined whether the page interval between the toner images is under the exposure unit 13.

If the page interval is under the exposure unit 13, the routine proceeds to step S24, otherwise, the routine is ended.

In step S24, the exposure flux of the laser beam from the exposure unit 13 is adjusted.

When it is not necessary to perform the toner adhesion quantity correction procedure, or the page interval is not under the exposure unit 13, the routine is ended.

The above toner adhesion quantity correction procedure is executed for each color of black (K), yellow (Y), magenta (M), cyan (C).

Therefore, it is possible to stably correct the adhesion quantity of the image visualizing agent with high precision during a process of continuous printing on the recording medium.

It should be noted in the present embodiment, the above adhesion quantity detection methods and the above adhesion quantity correction timings can be combined appropriately.

According to the present embodiment, it is possible to correct the adhesion quantity of the image visualizing agent with high precision without stopping a continuous printing process, hence, it is possible to provide an image forming apparatus able to form a full color image with high printing quality.

Second Embodiment

Descriptions are made of a method of correcting position shift of image visualizing agents in the image forming apparatus of the present invention.

The configuration of the image forming apparatus of the present embodiment is similar to the configuration of the image forming apparatus of the first embodiment, and overlapping descriptions are omitted. Below, explanations are made of only the differences between the image forming apparatus of the present embodiment the image forming apparatus of the first embodiment, such as the detector 19 and the correction controller 24.

<Detection of Position Shift>

Below, detection of the position shift is described with reference to the drawings.

Figure 8:
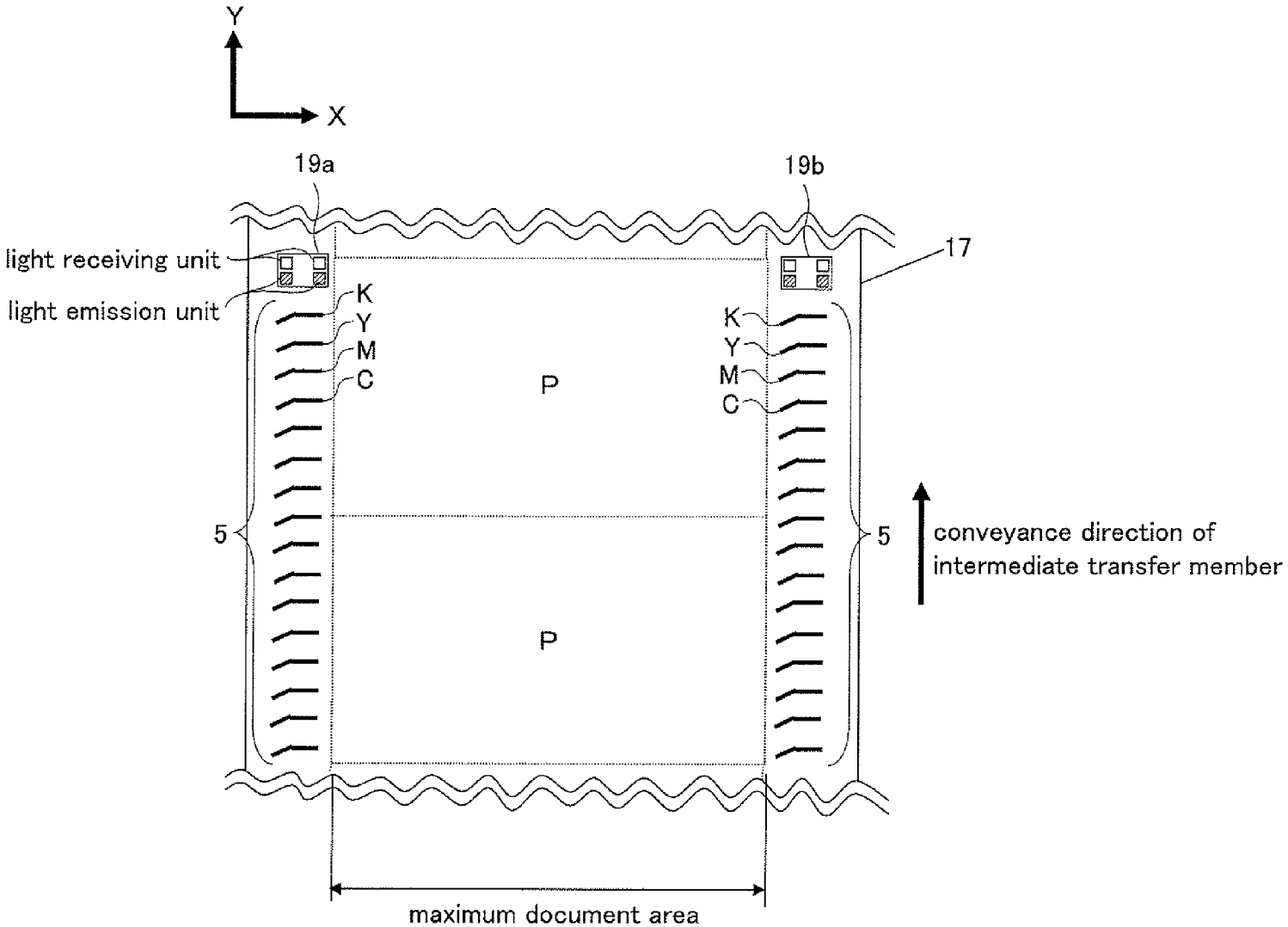
FIG. 8 is a schematic view of a portion of the image forming apparatus of the second embodiment for illustrating a method of detecting the position shift.

FIG. 8 is a schematic view of a portion of the image forming apparatus of the present embodiment for illustrating a method of detecting the position shift.

As shown in FIG. 3, there are provided a correction pattern image 5, which is a pattern including plural line images having a specified length in an X direction perpendicular to the moving direction (namely, the conveyance direction) of the intermediate transfer unit 17 (namely, having a specified length in the main scan direction), and plural line images having a specified length in the moving direction (namely, the conveyance direction) Y of the intermediate transfer unit 17 (namely, having a specified length in the sub scan direction).

In addition, in the correction pattern image 5, black (K), yellow (Y), magenta (M), and cyan (C) patterns are arranged at certain intervals to form a certain shape. The correction pattern image 5 is transferred to the two end portions of the intermediate transfer unit 17 in the main scan direction, and is located outside the maximum document region P of the intermediate transfer unit 17 allowed in the image forming apparatus 10.

The detector 19 includes an optical system having at least one group of a light emitter and a light receiver. The light from the light emitter is emitted to the correction pattern image 5, which is used for correcting the position shift and includes sub-patterns of different colors and sequentially formed on the intermediate transfer unit 17. The light receiver of the detector 19 receives reflected light from the correction pattern image 5. The detector 19 is able to detect the position shift between the sub-patterns of different colors in the correction pattern image 5 optically read by the detector 19. Namely, the detector 19 functionally has a position shift detection section for detecting the position shift between the sub-patterns, and outputs the detection results (such as position information of the correction pattern image 5, and the position shift between the sub-patterns of different colors) to the correction controller 24.

In the present embodiment, for example, two detectors 19*a* and 19*b* are arranged on the respective two sides of the intermediate transfer unit 17 outside the maximum document region of the intermediate transfer unit 17 for detecting the position shift. Since two detectors 19*a* and 19*b* are arranged on the two sides of the intermediate transfer unit 17 for detecting the position shift, it is possible to detect width fluctuation in the main scan direction, and to detect the position shift of the whole page with high precision; this enables optimum corrections.

The correction controller 24 compares the position shift between the sub-patterns of different colors from the detectors 19*a* and 19*b* to a preset correction criterion to determine whether it is necessary to execute a position shift correction procedure, and calculates correction data for the object position shift.

For example, the correction controller 24 compares the position of the detected correction pattern image 5 to the position of a preset pattern image, and correction data are calculated from the difference for correcting the starting position (timing) in the main scan direction, the scan magnification in the main scan direction, and the starting position (timing) in the sub scan direction.

Further, the correction controller 24 generates control signals based on the correction data for controlling the exposure units 13 of different colors, and outputs the control signal to the exposure units 13 so as to correct the write (irradiation) starting timings of the laser beams 1 at appropriate timings.

Note that the above correction data can be translated as irradiation starting position in the main scan direction, the main scan magnification in the main scan direction, and the light emission starting position in the sub scan direction of the laser beam from the exposure units 13.

In addition, since the above position shift is caused by a temperature increase during a continuous printing process, it is preferable that the position shift correction procedure be executed after printing a certain number of pages.

<Control of Position Shift Correction>

Figure 9:
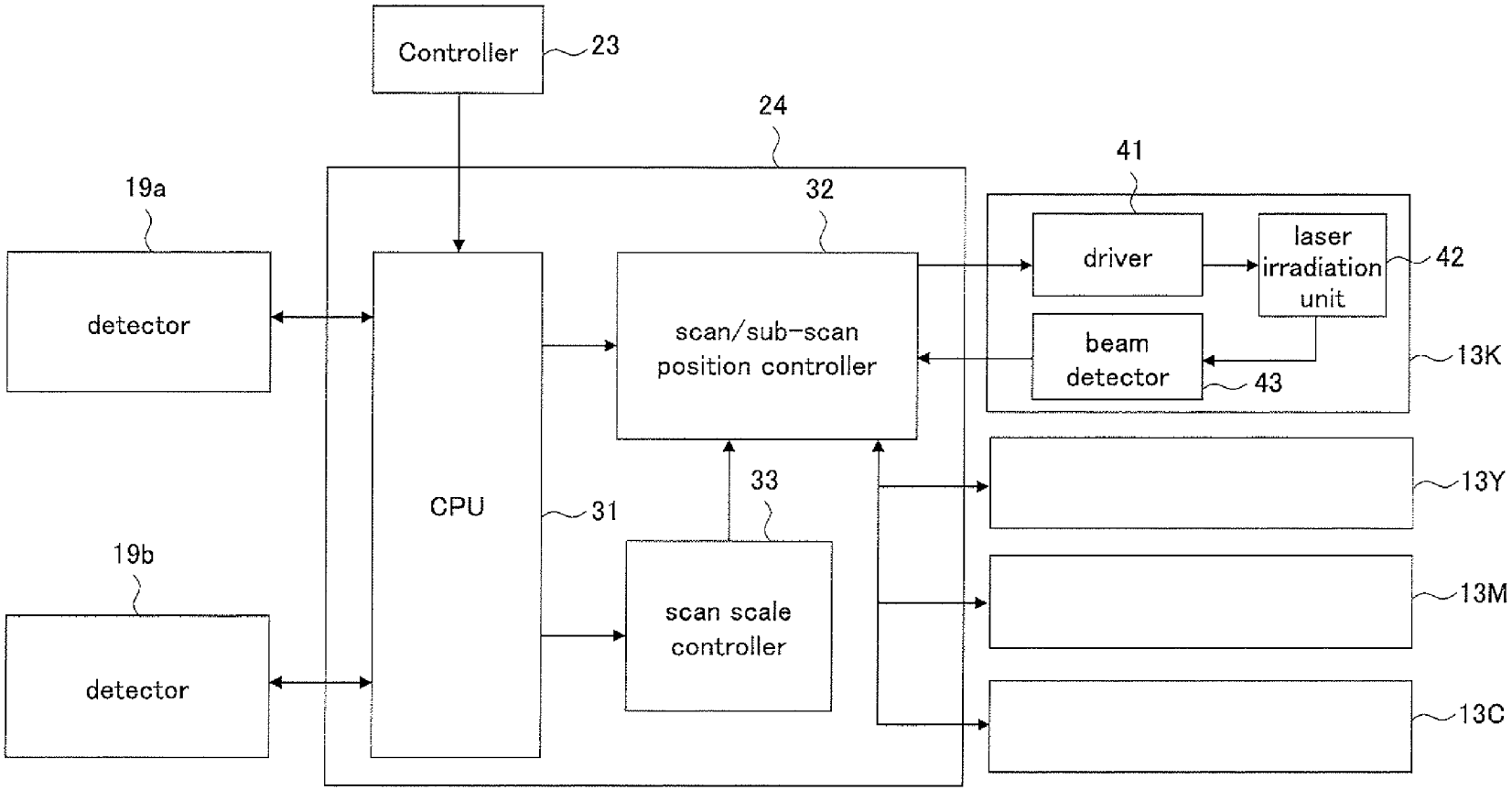
FIG. 9 is a block diagram illustrating a configuration of the correction controller 24 and the exposure unit 13 for position shift correction.

FIG. 9 is a block diagram illustrating a configuration of the correction controller 24 and the exposure unit 13 for position shift correction.

In FIG. 9, the correction controller 24 includes a CPU (Central Processing Unit) 31, a scan/sub-scan position controller 32, and a scan magnification controller 33.

In the correction controller 24 shown in FIG. 9, CPU 31 receives detection signals from the detectors 19*a*, 19*b*, and calculates the position shift (color deviation) and correction data. Further, CPU 31 receives a paper feeding signal from the controller 23, and generates timing of correction (for example, page interval information) from the paper feeding signal.

The scan/sub-scan position controller 32 controls, based on the control signal from the CPU 31, the light emission starting position in the main scan and sub scan directions of the laser beam, and outputs instruction signals to the exposure units 13 corresponding to different colors to direct emission of the laser beams. In addition, the scan/sub-scan position controller 32 determines whether the irradiation is appropriately performed by using signals from the exposure units 13.

The scan magnification controller 33 controls the scan magnification in the main scan direction.

Further, the correction controller 24 transmits a control signal for controlling the exposure units 13.

The exposure unit 13 shown in FIG. 9 includes a driver 41, a laser irradiation unit 42, and a beam detector 43.

The driver 41 receives the control signal from the scan/sub-scan position controller 32, sets the irradiation timing and the intensity of the laser beams based on the received signal, and outputs the setting values to the laser irradiation unit 42.

Based on the control signal received from the driver 41, the laser irradiation unit 42 emits the laser beams having the specified intensity at the irradiation timing.

The beam detector 43 detects a portion of the laser beam emitted from the laser irradiation unit 42, and determines whether a preset irradiation criterion is satisfied based on the detected laser beam. Then, the beam detector 43 outputs information of the laser beam to the scan/sub-scan position controller 32.

In this way, the correction controller 24 is able to obtain the corrected values quickly.

In addition, in FIG. 9, the exposure unit 13*k* corresponding to black (K) is used as an example. Similarly, each of the exposure units 13*y*, 13*m*, 13*c* corresponding to other colors also includes the driver 41, the laser irradiation unit 42, and the beam detector 43. In other words, the correction controller 24 generates a control signal for correcting the position shift for each color, and controls the correction for the corresponding color.

<Procedure of Position Shift Correction Control>

Figure 10:
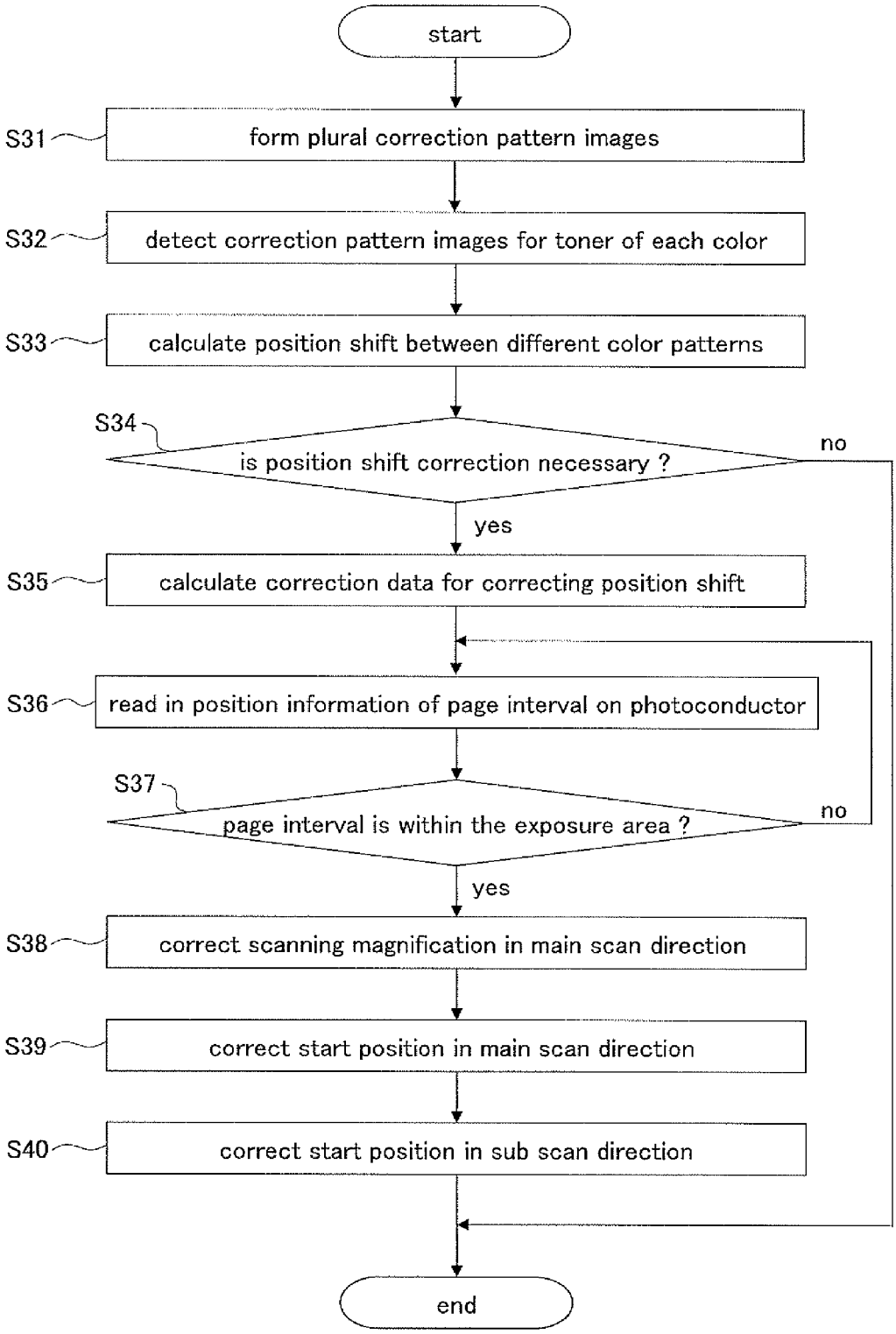
FIG. 10 is a flowchart illustrating an example of the position shift (color deviation) correction procedure during a printing process.

FIG. 10 is a flowchart illustrating an example of the position shift (color deviation) correction procedure during a printing process.

As shown in FIG. 10, in step S31, when the position shift correction procedure is started during a continuous printing process, plural correction pattern images are formed.

In step S32, the correction pattern images for toner of different colors, formed in step S31, are detected.

In step S33, the position shift between different color-patterns is calculated from the detected correction pattern images.

In step S34, based on the position shift calculated in step S33, it is determined whether it is necessary to perform position shift correction.

If it is necessary to perform the position shift correction, the routine proceeds to step S35, otherwise, the routine is ended.

When making the above determination, for example, when the difference between the position shift calculated in step S33 and a preset position shift value is greater than a preset value, it is determined that the position shift correction is necessary.

In step S35, correction data for correcting the position shift of each color are calculated. For example, the position of the detected correction pattern is compared to a preset position of the correction pattern, and from the difference, correction data are calculated for the starting position (timing) in the main scan direction, the scan magnification in the main scan direction, and the starting position (timing) in the sub scan direction.

In step S36, the position information of the page interval between printing pages on the photoconductive member 11 is read in.

In step S37, it is determined whether the page interval is within the exposure area.

If the page interval is within the exposure area, the routine proceeds to step S38, otherwise, the routine returns to step S36, to repeat the step S36 until the page interval on the photoconductive member 11, which is rotating, is within the exposure area, then the position information of the page interval on the photoconductive member 11 is read in.

When making the above determination, for example, it is determined whether the end of page interval (the bottom of the preceding page) is under the exposure area when the laser beam is emitted from the laser unit, and arrives at the exposure point.

In step S38, the scan magnification in the main scan direction of the laser beam is corrected.

In step S39, after the scan magnification in the main scan direction of the laser beam is corrected, the starting position (timing) in the main scan direction is corrected.

In step S40, the starting position (timing) in the sub scan direction is corrected.

Therefore, during a process of continuous printing on a recording medium like continuous paper, it is possible to perform the position shift correction at specified timings.

It should be noted that the order of step S38 through step S40 can be changed. For example, first, in step S39, the starting position of the laser beam in the main scan direction is corrected, then the scan magnification in the main scan direction of the laser beam is corrected. In addition, among corrections made in step S38 through step S40, only one correction may be made.

Below, timing of executing position shift correction control is explained.

Figure 11:
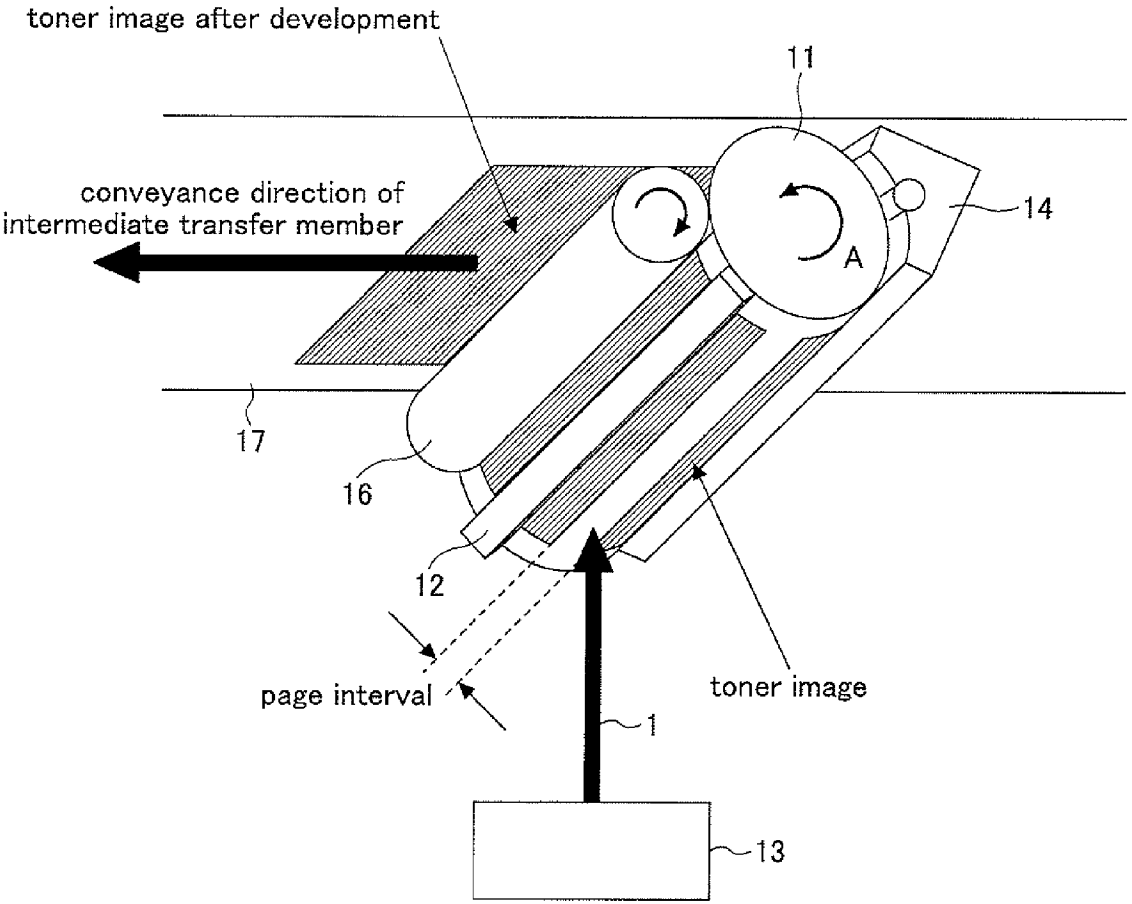
FIG. 11 is a schematic view of the image forming section of the image forming apparatus according to the present embodiment for illustrating operations of the position shift correction control.

FIG. 11 is a schematic view of the image forming section of the image forming apparatus according to the present embodiment for illustrating operations of the position shift correction control.

As illustrated in FIG. 5, the image forming section of the image forming apparatus of the present embodiment includes the photoconductive members 11, the charging units 12, the exposure units 13, the developing units 14, and the intermediate transfer unit 17.

Figure 12:
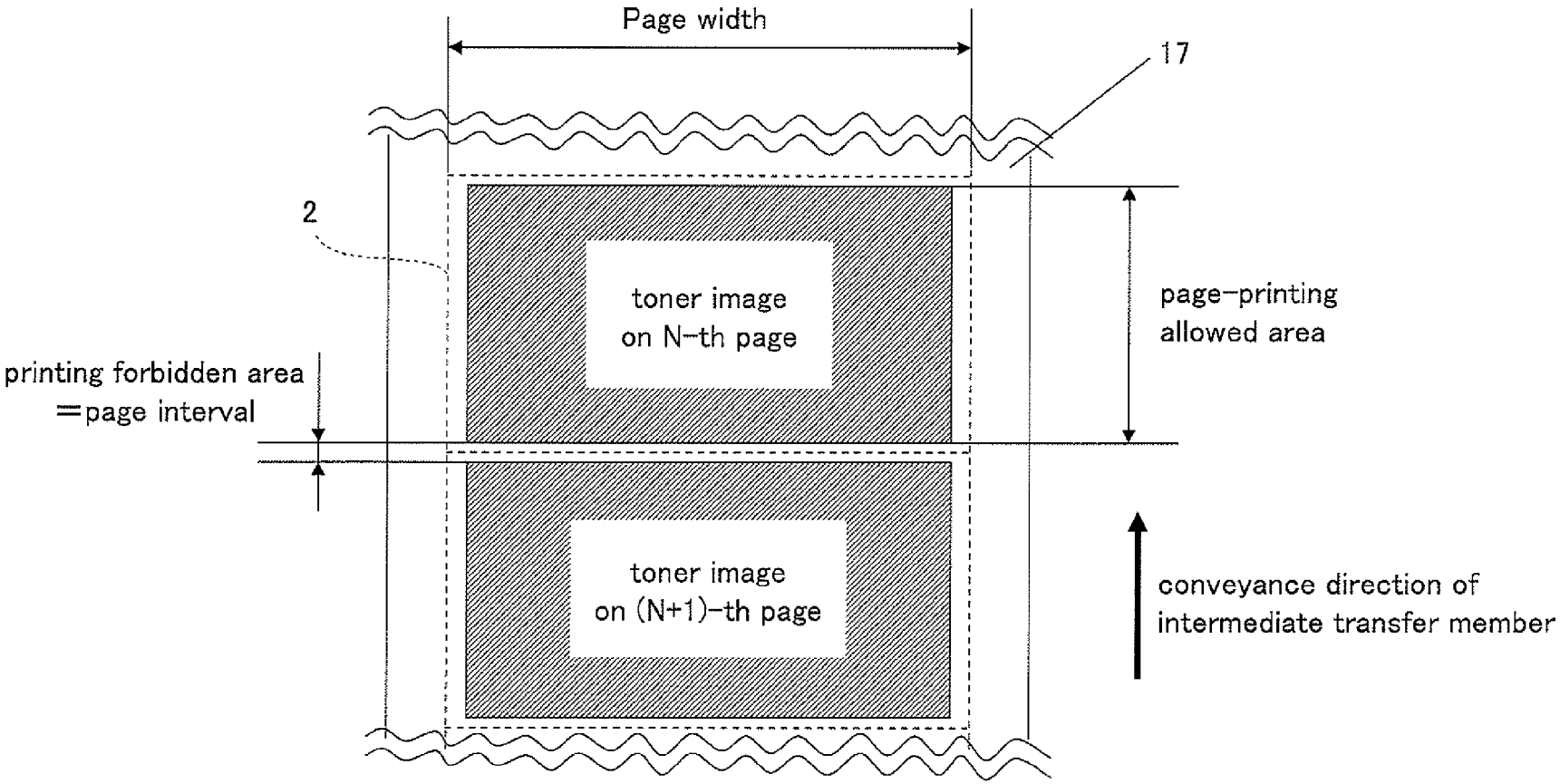
FIG. 12 is a schematic view of a portion of the image forming apparatus of the present embodiment for illustrating timing of the position shift (color deviation) correction control.

FIG. 12 is a schematic view of a portion of the image forming apparatus of the present embodiment for illustrating timing of the position shift (color deviation) correction control.

As shown in FIG. 12, in the position shift correction control in the image forming section, when the end position corresponding to the page interval between the toner images on the photoconductive member 11 is between the charging units 12 and the developing units 14, that is, at the timing when the end position of the page interval is under the exposure area of the laser beam emitted from the exposure unit 13, the starting position (timing) in the main scan direction, the scan magnification in the main scan direction, and the starting position (timing) in the sub scan direction are corrected.

Specifically, in FIG. 12, it is illustrated that the position corresponding to the page interval between the toner images on the photoconductive member 11 is above the intermediate transfer unit 17, and the recording medium 2 corresponds to the area enclosed by the dashed lines.

In the present embodiment, when continuous paper is used, different from cut sheets, there are no intervals between pages. In this case, the area of the continuous paper to which the toner images are transferred constitutes the printing-allowed area as shown in FIG. 12, which is the area of the continuous paper excluding a printing-forbidden area. Namely, the printing-forbidden area between the toner image on the N-th page and the toner image on the (N+1)-th page corresponds to the page interval. For example, the printing-forbidden area has a width of ⅓ inch.

As described above, by making the position shift correction at the timing corresponding to the page interval, it is possible to make the position shift correction at specified timing with high precision during a process of continuous printing on the recording medium. Specifically, it is possible to correct the printing starting position shift or the width shift at predetermined timing even during a continuous printing process without stopping the printing process. Thus, it is possible to provide an image forming apparatus able to form a full color image with high printing quality.

It should be noted that the technique of correcting the adhesion quantity of the image visualizing agent as described in the first embodiment can be appropriately combined with the technique of correcting the position shift, and this combined technique may result in image formation of even higher quality.

According to the present invention, it is possible to correct the adhesion quantity of the image visualizing agent with high precision and correct position shift of a visible image during a continuous printing process without stopping the continuous printing process; hence, it is possible to provide an image forming apparatus able to form a full color image with high printing quality.

While the present invention is described with reference to specific embodiments chosen for purpose of illustration, it should be apparent that the invention is not limited to these embodiments, but numerous modifications could be made thereto by those skilled in the art without departing from the basic concept and scope of the invention.

For example, the image forming apparatus of the embodiments of the present invention is able to perform the adhesion quantity correction and the position shift correction with high precision for not only continuous paper but also cut sheets. In addition, the image forming method of the present invention is applicable to not only the tandem image forming apparatus but also the field of electrostatic recording devices like electrophotographic printers or copiers.

This patent application is based on Japanese Priority Patent Applications No. 2006-059647 filed on Mar. 6, 2006, No. 2006-066289 filed on Mar. 10, 2006, and No. 2007-008207 filed on Jan. 17, 2007, and the entire contents of which are hereby incorporated by reference.

What is claimed is:

1. An image forming apparatus, comprising:

an intermediate transfer unit;

a plurality of photoconductors that are arranged along a moving direction of the intermediate transfer unit;

a plurality of charging units that uniformly charge surfaces of the photoconductors;

a plurality of exposure units that form electrostatic latent images exposed on the surfaces of the charged photoconductors;

a plurality of developing units that supply image visualizing agents to the photoconductors retaining the electrostatic latent images, and form visible images on the photoconductors;

a plurality of first transferring units that transfer the visible images formed on the photoconductors to the intermediate transfer unit;

and a second transferring unit that transfers the visible images on the intermediate transfer unit to a recording medium; wherein the intermediate transfer unit includes a correction pattern image formed in a region out of a predetermined maximum document region of the intermediate transfer unit in a direction perpendicular to the moving direction in a state where a printing operation is continued, a detector is provided in the intermediate transfer unit at a position opposite to the correction pattern image for detecting the correction pattern image, a correction controller is provided for correcting, based on detection results of the detector, setting values of one or more of the charging units, the exposure units, and the developing units when a region corresponding to an interval between the visible images formed on the photoconductors passes a position beneath one of the one or more of the charging units, the exposure units, and the developing units so that the setting values of the charging units are corrected when the region corresponding to the interval between the visible images formed on the photoconductors is passing the position between a charge start position and a charge end position of the charging units, the setting values of the exposure units are corrected when the region corresponding to the interval between the visible images formed on the photoconductors is passing the position between an exposure start position and an exposure end position of the exposure units, and the setting values of the developing units are corrected when the region corresponding to the interval between the visible images formed on the photoconductors is passing the position between a development start position and development end position of the developing units.

2. The image forming apparatus as claimed in claim 1, wherein the detector detects an adhesion quantity of the image visualizing agent from the correction pattern image formed on the intermediate transfer unit by the first transferring units.

3. The image forming apparatus as claimed in claim 2, wherein the correction controller corrects one or more of a charging voltage of the charging units and a developing bias voltage of the developing units based on the adhesion quantity of the image visualizing agent detected by the detector.

4. The image forming apparatus as claimed in claim 2, wherein the correction controller corrects an exposure flux of the exposure units based on the adhesion quantity of the image visualizing agent detected by the detector.

5. The image forming apparatus as claimed in claim 1, wherein the detector detects a position shift of the visible images from the correction pattern image formed on the intermediate transfer unit by the first transferring units.

6. The image forming apparatus as claimed in claim 5, wherein based on the position shift detected by the detector, the correction controller corrects one or more of a write starting position in a main scan direction of a laser beam emitted from the exposure units on the photoconductors, a scan magnification of the laser beam, and a write starting position in a sub scan direction of the laser beam on the photoconductors.

7. The image forming apparatus as claimed in claim 1, wherein the recording medium is a web-like recording medium.

8. An image forming method of an image forming apparatus including an intermediate transfer unit;

a plurality of photoconductors that are arranged along a moving direction of the intermediate transfer unit;

a plurality of charging units that uniformly charge surfaces of the photoconductors;

a plurality of exposure units that form electrostatic latent images exposed on the surfaces of the charged photoconductors;

a plurality of developing units that supply image visualizing agents to the photoconductors retaining the electrostatic latent images, and form visible images on the photoconductors;

a plurality of first transferring units that transfer the visible images formed on the photoconductors to the intermediate transfer unit;

and a second transferring unit that transfers the visible images on the intermediate transfer unit to a web-like recording medium, said method comprising:

a detection step of detecting a correction pattern image formed in a region outside of a predetermined maximum document region of the intermediate transfer unit in a direction perpendicular to the moving direction in a state where a printing operation is continued;

and a correction control step of correcting, based on detection results obtained in the detection step, setting values of one or more of the charging units, the exposure units, and the developing units when a region corresponding to an interval between the visible images passes a position beneath one of the one or more of the charging units, the exposure units, and the developing units so that the setting values of the charging units are corrected when the region corresponding to the interval between the visible images formed on the photoconductors is passing the position between a charge start position and charge end position of the charging units, the setting values of exposure units are corrected when the region corresponding to the interval between the visible images formed on the photoconductors is passing the position between an exposure start position and an exposure end position of the exposure units, and the setting values of the developing units are corrected when the region corresponding to the interval between the visible images formed on the photoconductors is passing the position between a development start position and a development end position of the developing units.

9. The method as claimed in claim 8, wherein in the detection step, an adhesion quantity of the image visualizing agent is detected from the correction pattern image formed on the intermediate transfer unit by the first transferring units.

10. The method as claimed in claim 9, wherein in the correction control step, one or more of a charging voltage of the charging units and a developing bias voltage of the developing units are corrected based on the adhesion quantity of the image visualizing agent detected by the detector.

11. The method as claimed in claim 9, wherein in the correction control step, an exposure flux of the exposure units is corrected based on the adhesion quantity of the image visualizing agent detected by the detector.

12. The method as claimed in claim 8, wherein in the detection step, a position shift of the visible images is detected from the correction pattern image formed on the intermediate transfer unit by the first transferring units.

13. The method as claimed in claim 12, wherein in the correction control step, based on the position shift detected in the detection step, one or more of a write starting position in a main scan direction of a laser beam emitted from the exposure units on the photoconductors, a scan magnification of the laser beam, and a write starting position in a sub scan direction of the laser beam on the photoconductors is corrected.

14. The image forming apparatus as claimed in claim 6, wherein, when a region corresponding to a page interval between printing pages on each photoconductor is not in an exposure area, the correction controller continuously reads position information of the page interval on the photoconductor, when a region corresponding to the page interval of the visible images on the photoconductor is not in a region between the exposure start position and the exposure end position, until the region corresponding to the page interval on the photoconductor, which is rotating, enters the region between the exposure start position and the exposure end position.

15. An image forming apparatus, comprising:

an intermediate transfer unit;

a plurality of photoconductors that are arranged along a moving direction of the intermediate transfer unit;

a plurality of charging units that uniformly charge surfaces of the photoconductors;

a plurality of exposure units that form electrostatic latent images exposed on the surface of the charged photoconductors;

a plurality of developing units that supply image visualizing agents to the photoconductors retaining the electrostatic latent images, and form visible images on the photoconductors;

a plurality of first transferring units that transfer the visible images formed on the photoconductors;

a second transferring unit that transfers the visible images on the intermediate transfer unit to a recording medium, wherein said intermediate transfer unit includes a correction pattern image area to form a correction pattern image therein, the correction pattern image area being provided outside a previously set maximum area of the recording medium in a direction perpendicular to the moving direction of the intermediate transfer unit;

a detector that detects the correction pattern image and provided at a position opposite to the correction pattern image on the intermediate transfer unit; and a correction controller that corrects a setting value of each exposure unit based on a result of detection by the detector during a period in which a region corresponding to a page interval of visible images formed on each photoconductor is passing an exposure area of the exposure unit, wherein, when the region corresponding to the page interval on each photoconductor is not in the exposure area, the correction controller continuously reads position information of the page interval on the photoconductor, when a region corresponding to the page interval of the visible images on the photoconductor is not in a region between the exposure start position and the exposure end position, until the region corresponding to the page interval on the photoconductor, which is rotating, enters the region between the exposure start position and the exposure end position.

16. The image forming apparatus as claimed in claim 1, further comprising a control unit that controls a paper feed signal and a system clock signal and outputs the paper feed signal and the system clock signal to said collection controller, wherein said correction controller compares the detection result of said detector with a previously set reference correction condition to determine whether a correction is needed, and creates a control signal for correction when the correction is needed, and supplies said control signal for correction to at least one of said charging units, said exposure units and said developing units based on information regarding a predetermined timing of a page interval between the visible images on said photoconductors that is acquired from said control unit so as to adjust a setting value of one of the units to which the control signal is supplied to perform the correction at the predetermined timing.

17. The method as claimed in claim 8, further comprising controlling a paper feed signal and a system clock signal by a control unit, and outputting the paper feed signal and the system clock signal to said collection controller, wherein correction control step comprises comparing the detection results with a previously set reference correction condition to determine whether a correction is needed, and creating a control signal for correction when the correction is needed, and supplying said control signal for correction to at least one of said charging units, said exposure units and said developing units based on information regarding a predetermined timing of a page interval between the visible images on said photoconductors that is acquired from said control unit so as to adjust a setting value of one of the units to which the control signal is supplied to perform the correction at the predetermined timing.

* * * * *